US007896647B2

(12) United States Patent
Kobayashi et al.

(10) Patent No.: US 7,896,647 B2
(45) Date of Patent: Mar. 1, 2011

(54) COMBUSTION WITH VARIABLE OXIDANT LOW NOX BURNER

(75) Inventors: William Thoru Kobayashi, East Amherst, NY (US); Abilio Tasca, Sao Paulo (BR); Francisco Dominques Alves De Sousa, Sao Paulo (BR)

(73) Assignee: Praxair Technology, Inc., Danbury, CT (US)

( * ) Notice: Subject to any disclaimer, the term of this patent is extended or adjusted under 35 U.S.C. 154(b) by 99 days.

(21) Appl. No.: 12/463,486

(22) Filed: May 11, 2009

(65) Prior Publication Data

US 2009/0220900 A1 Sep. 3, 2009

Related U.S. Application Data

(62) Division of application No. 11/945,433, filed on Nov. 27, 2007, now Pat. No. 7,549,858.

(60) Provisional application No. 60/872,725, filed on Dec. 4, 2006.

(51) Int. Cl.
*F23D 11/40* (2006.01)
*F23D 11/70* (2006.01)

(52) U.S. Cl. ..... 431/159; 431/187; 431/8; 431/10; 432/9; 239/589

(58) Field of Classification Search ..... 431/159, 431/8, 10, 187; 432/9
See application file for complete search history.

(56) References Cited

U.S. PATENT DOCUMENTS

| | | | | |
|---|---|---|---|---|
| 4,147,115 | A * | 4/1979 | Leppert | 110/244 |
| 5,454,712 | A | 10/1995 | Yap | |
| 5,611,683 | A | 3/1997 | Baukal, Jr. et al. | |
| 5,904,475 | A | 5/1999 | Ding | |
| 6,193,173 | B1 | 2/2001 | Bodelin et al. | |
| 6,283,747 | B1 | 9/2001 | Legiret et al. | |
| 6,579,088 | B2 | 6/2003 | Legiret et al. | |
| 7,028,622 | B2 | 4/2006 | Taylor | |

FOREIGN PATENT DOCUMENTS

| | | | |
|---|---|---|---|
| DE | 10160325 | A1 | 6/2003 |
| DE | 10160325 | A1 * | 6/2003 |
| DE | 102004037620 | A1 | 2/2006 |
| EP | 0156958 | A | 10/1985 |
| EP | 0775868 | A | 5/1997 |
| JP | 1167502 | A | 7/1989 |

* cited by examiner

*Primary Examiner*—Steven B McAllister
*Assistant Examiner*—Nikhil Mashruwala
(74) *Attorney, Agent, or Firm*—Donald T. Black

(57) ABSTRACT

Heating provided by a burner that combusts hydrocarbon fuel can be provided at a sequence of different heat transfer rates by adjusting the total oxygen concentration of oxidant streams fed to the burner. A burner with which the method can be practiced is also disclosed.

4 Claims, 3 Drawing Sheets

COMBUSTION WITH VARIABLE OXIDANT LOW NOX BURNER

This application claims priority from U.S. provisional application Ser. No. 60/872,725 filed Dec. 4, 2006, the content of which is hereby incorporated herein by reference, and this application is a divisional of and claims priority from U.S. application Ser. No. 11/945,433, filed Nov. 27, 2007 now U.S. Pat. No. 7,549,858.

FIELD OF THE INVENTION

The present invention relates to combustion that generates heat useful for heating materials to high temperatures and for holding them at high temperatures.

BACKGROUND OF THE INVENTION

Many industrial applications require heating materials to high temperatures for melting, heat treating, and the like. Heat is often provided by combusting hydrocarbon fuels. However, in these applications the need can arise for supplying heat at different heating rates at different times. Conventional approaches to this need can involve heating the material to a desired high temperature, then discontinuing the combustion in order to let the temperature of the material decrease, and then recommencing combustion when the temperature drops enough that additional heat must be applied. Such "on/off" operation is inefficient in its consumption of fuel and oxidant, and it risks generating unacceptable levels of undesirable byproducts such as nitrogen oxides. Also, it risks imposing thermal stresses on the material by the cycling of the temperature and/or operational stresses on the valves and burners that are repeatedly forced to open and close as the combustion is stopped and started. Other approaches, such as providing two separate burner systems each adapted for a particular type of combustion, with only one system operated at a time, are expensive and take up space.

Therefore, there remains a need for methods and apparatus that enable more efficient and more environmentally tolerable heating of materials, especially under conditions in which the amount of heating is to vary over time.

BRIEF SUMMARY OF THE INVENTION

One aspect of the present invention is a burner system comprising a burner body and a burner block, wherein (A) the burner body comprises a plenum body which has back and side surfaces that enclose a plenum space which is open at its front in a uniplanar plenum opening that is defined by the front edges of said side surface, a feed inlet in a back or side surface of said plenum body, through which gas can be fed into said plenum space, a first hollow body that is situated completely within said plenum space and that is closed against passage of gas between said plenum space and the interior of said hollow body, wherein the hollow body does not extend through said plenum opening, a feed inlet through a surface of said hollow body, through which gas can be fed into the interior of said hollow body, 2 to 16 outlet ports through a surface of said hollow body, through which gas can pass out of said hollow body, each oriented to point outwardly of said plenum space toward the plenum opening, wherein the outer ends of said outlet ports do not extend beyond the plane of said plenum opening, a first tube extending from outside the back surface of said plenum body through the plenum space to a first tube end that is located a first distance outside the plane of the plenum opening, wherein the first tube is closed against passage of gas into said first tube from the plenum space and from the interior of the hollow body, a second tube, located inside the first tube, extending from outside the back surface of said plenum body through the plenum space to a second tube end that is located a second distance outside the plane of the plenum opening, wherein said second distance is greater than first distance, wherein said second tube is closed against passage of gas into said second tube from the plenum space, from the interior of the hollow body, and from the first tube, and wherein the axes of the first and second tubes are coaxial or parallel, a third tube, located inside the second tube, extending from outside the back surface of said plenum body through the plenum space to a third tube end that is located said second distance outside the plane of the plenum opening, wherein said third tube is closed against passage of gas into said third tube from the plenum space, from the interior of the hollow body, and from the second tube, and wherein the axes of the first, second and third tubes are coaxial or parallel, a feed inlet for receiving gas into the space between the first and second tubes, a feed inlet for receiving gas into the space between the second and third tubes, and a feed inlet for receiving fuel into said third tube; and (B) the burner block comprises a front surface and a rear surface, a first passageway extending through the block, composed of a barrel segment that extends into the block from said rear surface to the inner end of said barrel segment for a length at least equal to said first distance, the diameter of said barrel segment permitting said first tube to fit snugly into said barrel segment to minimize passage of gas in said barrel segment outside said first tube, a throat segment having upstream and downstream ends and whose diameter is constant along its axis and is less than the diameter of said barrel segment and is greater than the outer diameter of said second tube, wherein the distance from the rear surface of the block to said upstream end is greater than said first distance and less than said second distance, and wherein the distance from the rear surface of said block to said downstream end is greater than said second distance, a tapered segment that extends axially from the inner end of said barrel segment to said upstream end of said throat segment, a port segment that extends into the block from the front surface of the block to the inner end of the port segment, wherein the diameter of the port segment is constant and is greater than the diameter of said throat segment a quarl segment that extends from the downstream end of said throat segment to the inner end of said port segment, wherein said segments are coaxial, and the sum of the axial lengths of the port segment and the quarl segment is up to 50 times the diameter of the largest diameter of the quarl segment; the axial length of the throat segment is up to 50 times the diameter of the largest diameter of the quarl segment; the ratio of the largest diameter of the quarl segment to the diameter of the throat segment is 1 to 50; and the distance from the discharge openings of the secondary passageways to the axis of the first passageway is 1-10 times the diameter of the throat segment, a plurality of secondary passageways, greater in number than the number of said outlet ports, extending through said block from inlet openings in the rear surface of said block to discharge openings in the front surface of said block, wherein said inlet openings are close enough to said first passageway that when the front edges of said plenum body are in contact with the rear surface of said block, said inlet openings are in gas contact with said plenum space, and wherein each secondary passageway has an axis at its discharge opening that converges toward the axis of the first passageway at an angle of up to 60°, diverges from the axis of the first passageway at an angle of up to 85°, or is parallel to the axis of the first passageway;

wherein said burner body is positioned with respect to said burner block so that the front edges of said plenum body are in contact with the rear surface of said block to prevent passage of gas out of said plenum space except into said secondary passageways and the first and second tubes extend into said first passageway, and outlet ports are aligned with secondary passageways so that gas passing from an outlet port passes through a secondary passageway with which it is aligned.

Another aspect of the invention is a method for heating a substrate, comprising (A) providing the aforementioned burner system, (B) determining a first rate of heat transfer to the substrate, (C) determining the rates at which fuel and oxidant are to be fed to said burner system to be combusted thereat, and the total oxygen concentration of said oxidant to be combusted, to generate heat of combustion to be transferred to said substrate from said burner system at said first rate, (D) feeding fuel, and oxidant having said total oxygen concentration, at said rates to said burner system and combusting said fuel and said oxidant at said system to generate heat of combustion which is transferred to said substrate at said first rate, while apportioning the amounts of oxygen fed through said first and second tubes of said burner system with respect to the amounts of oxygen fed through said secondary passageways and said outlet ports of said burner system to minimize formation of NOx by said combustion, (E) determining a second rate of heat transfer to the substrate which is different from said first rate, (F) determining a new total oxygen concentration of said oxidant to be combusted and determining new rates at which said oxidant, or said oxidant and said fuel, are to be fed to said burner system and combusted thereat to generate heat of combustion to be transferred to said substrate at said second rate, and (G) while continuing to feed fuel and oxidant to said burner system, changing the total oxygen concentration fed to said burner system to said new total oxygen concentration and changing the rate at which said oxidant or said oxidant and said fuel are fed to said burner system, and continuing to combust said fuel and oxidant at said burner system, without discontinuing said combustion, to generate heat of combustion which is transferred to said substrate at said second rate, while apportioning the amounts of oxygen fed through said first and second tubes with respect to the amounts of oxygen fed through said secondary passageways and said outlet ports to minimize formation of NOx by said combustion, wherein the amount of oxygen fed to said burner system is at all times sufficient to maintain combustion of said fuel at said burner system, and wherein the amount of oxygen fed to said burner system is at all times sufficient to maintain the carbon monoxide content of the gaseous products of said combustion at less than 100 ppm.

As used herein, "NOx" means gaseous oxides of nitrogen, regardless of the number of atoms of nitrogen and of oxygen in any individual molecule of nitrogen and oxide, and mixtures thereof.

As used herein, "total oxygen concentration" means the total amount of oxygen fed through all inlets of a burner system through which gaseous oxidant is fed, including oxygen in any transport medium that is fed with fuel, divided by the total amount of gas fed through all inlets of a burner system through which gaseous oxidant is fed, including gas in any transport medium that is fed with fuel.

DETAILED DESCRIPTION OF THE INVENTION

The present invention is useful in any situation requiring heat transfer at a sequence of two or more different rates to a substrate, where the substrate or material in contact with the substrate is heated to temperatures (typically above 1000F) on the order of the temperatures that can be attained by combustion of hydrocarbon fuels such as natural gas, fuel oil, and the like. Suitable "substrates" with which this invention can be utilized include any material that one desires to heat, including in particular solids and liquids, such as metals and metallic precursors, whether to melt the solids, to melt solids already contained in liquid baths, to maintain a solid or a molten liquid at a desired high temperature, or to heat or preheat a container such as a ladle which is to receive and hold hot material.

One example of a use for this invention is in melting material by applying heat at a relatively high rate, then holding the resulting molten material at high temperature by applying heat at a lower heat transfer rate. Another example is preheating a ladle or tundish into which hot solid or molten material is to be fed, in which the ladle or tundish is heated at a high rate to a temperature at or near the temperature of the material, and then holding the hot solid or molten material at high temperature after it has been fed to the ladle or tundish, by applying heat at a relatively lower rate.

The present invention can be practiced usefully with burner systems such as the burner system illustrated in FIGS. 1-4 and described below. Such burner systems typically include a burner block, and a burner body assembled with the burner block to form the burner system.

Figure 1:
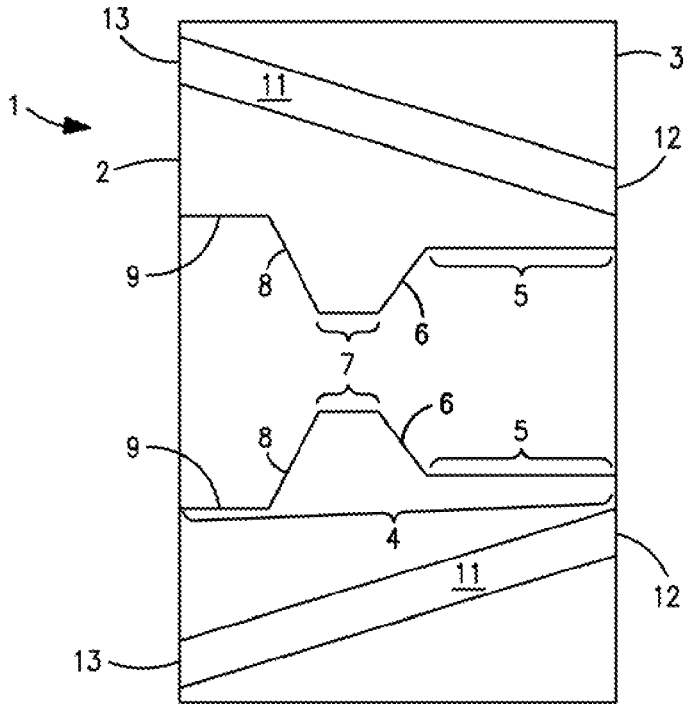
FIG. 1 is a cross-sectional view of a burner block that can be a component of the burner system with which the present invention can be utilized.

Referring first to FIG. 1, burner block 1 is shown before it is assembled with the burner body. Burner block 1 is a solid body of material capable of withstanding the elevated temperatures to which it is necessarily subjected when combustion is carried out at the burner body. Suitable materials of construction include refractory brick, such as high alumina, alumina, silica, AZS, mulite, zirconia, and/or zirconite, as well as metal structure including water-cooled metal structures.

Burner block 1 includes front surface 2 and rear surface 3. First passageway 4 passes through burner block 1 from rear surface 3 to front surface 2. First passageway 4 is comprised of a series of coaxial segments, each contributing to the performance of the burner system when the burner body is assembled together with the burner block.

Proceeding from the rear surface 3 of burner block 1, barrel segment 5 extends into burner block 1 from the rear surface, preferably as a cylinder of constant diameter if the section of burner body that will extend into barrel segment 5 is also cylindrical. The cross-sectional configuration of barrel segment 5 is preferably dimensioned to provided for a snug fit with the section of the burner body that is to occupy barrel segment 5, as described below. Preferably, the fit is snug enough that passage of gasses between the inner surface of barrel segment 5 and the outer surface of the corresponding section of the burner body is minimized or even prevented. The length of barrel segment 5, that is, its depth measured into burner block 1 from the rear surface 3 of burner block 1, is at least as long as the length of first tube 41 of burner body described herein.

Proceeding further into first passageway 4, tapered segment 6 extends from the inner end of barrel segment 5 to the upstream end of throat segment 7. The surface of tapered segment 6 can be flat (so that it is a section of a cone) or can be curved (i.e. so that the radius changes at a nonconstant rate along the axis).

Throat segment 7 is preferably of constant diameter, and is narrower than barrel segment 5. Thus, tapered segment 6 necessarily has a smaller cross-sectional area and diameter at its downstream end where it intersects throat segment 7 than at its upstream end where it intersects with barrel segment 5. Throat segment 7 is situated within burner block 1 so that its upstream end is closer to the rear surface of burner block 1 than is the end of second tube 43, as described further below. The downstream end of throat segment 7 should be further from the rear surface of burner block 1 than the end of second tube 43 is. In that way, the end of second tube 43 is situated within throat segment 7.

Throat segment 7 is connected at its downstream end to the upstream end of quarl segment 8, which is of increasing diameter with increasing axial distance from the rear surface of burner block 1. Quarl segment 8 ends at its downstream end at port segment 9, which is a segment of constant diameter larger than the diameter of throat segment 7. The surface of quarl segment 8 can be flat (so that it is a section of a cone) or can be curved (i.e. so that the radius changes at a nonconstant rate along the axis). Port segment 9 ends where it opens at the front surface 2 of burner block 1.

Burner block 1 also has a plurality of secondary passageways 11, each of which passes through burner block 1 from its rear surface to its front surface. Each secondary passageway 11 has an inlet opening 12 in the rear surface of burner block 1, and a discharge opening 13 in the front surface of burner block 1. From 2 to 16, and preferably 4 to 12, secondary passageways 11 extend through burner block 1. There should be more secondary passageways 11 through burner block 1 than the number of outlet ports 33 on the burner body with which the burner block is assembled.

The axis of each secondary passageway 11 can be parallel to the axis of first passageway 4, but preferably the axis of each secondary passageway 11 diverges or may converge with respect to the axis of passageway 4. As illustrated in FIG. 1, the respective axes diverge from the axis of first passageway 4; the preferred angle of the divergence is up to 85 degrees, more preferably up to 75 degrees. However, if desired, the axes of the secondary passageways can converge, toward the axis of first passageway 4, in which case the preferred angle of convergence is up to 60 degrees, more preferably up to 15 degrees.

Certain dimensional relationships between different portions of the burner block assist in carrying out the present invention. Thus, the sum of the axial lengths of the port segment and the quarl segment is up to 50 times the largest diameter of the quarl segment, and preferably up to 25 times that largest diameter. The axial length of the throat segment is up to 50 times, and more preferably up to 25 times, the diameter of the largest diameter of the quarl segment. The ratio of the largest diameter of the quarl segment to the diameter of the throat segment is 1 to 50, and preferably 1 to 25. The distance from the discharge openings 13 of the secondary passageways 11 to the axis of the first passageway 4 is 1 to 10, and preferably 1.5 to 8, times the diameter of the throat segment.

Figure 2:
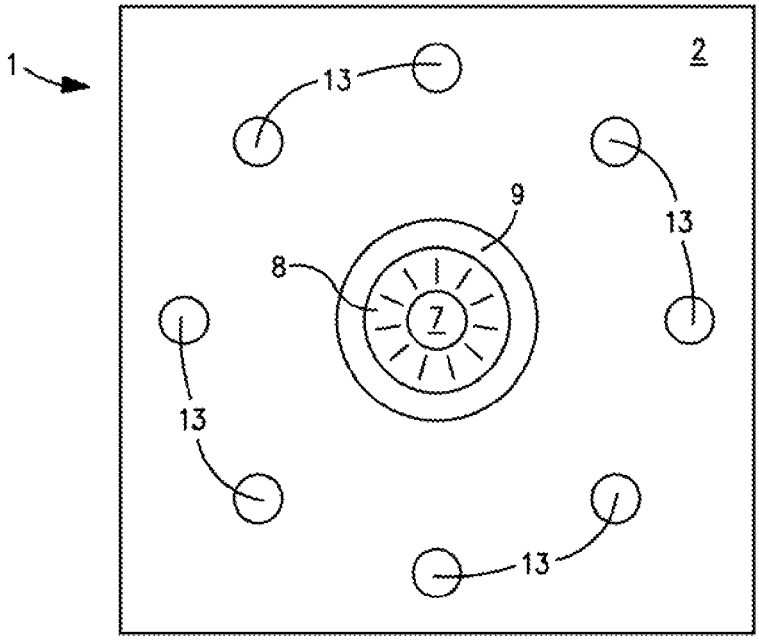
FIG. 2 is a perspective view of the front surface of a burner block with which the present invention can be utilized.

FIG. 2 illustrates an embodiment of the front of burner block 1. The discharge openings 13 of secondary passageways 11 can be seen, as can port segment 9, quarl segment 8, and the downstream end of throat segment 7. The burner body illustrated in FIG. 3 would be appropriate for assembly together with the burner block illustrated in FIG. 2, because the burner body of FIG. 3 contains only two outlet ports 33 each of which would be aligned with one of the secondary passageways 11, leaving additional secondary passageways 11 through which gas can flow from plenum space 23 out the respective discharge openings 13.

Figure 3:
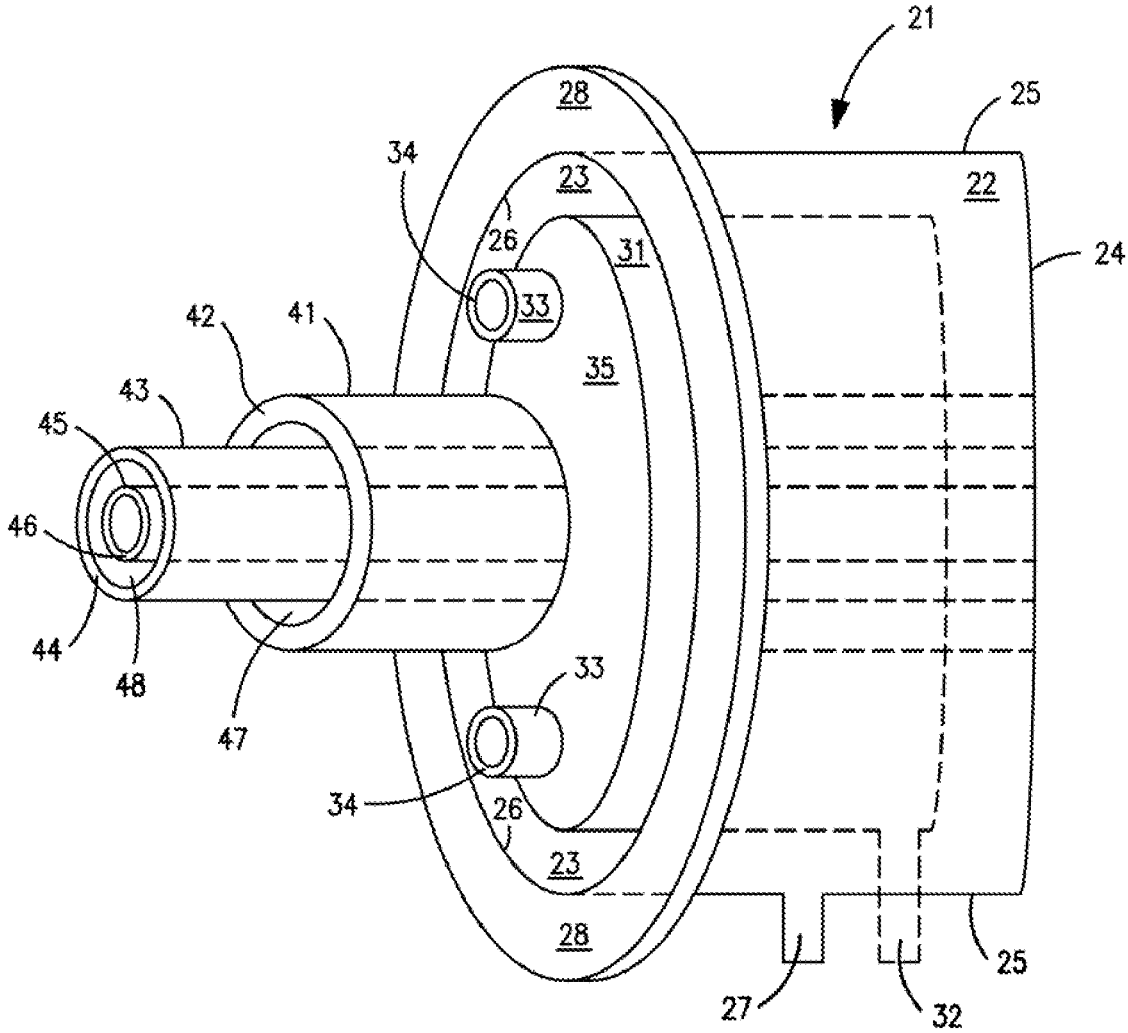
FIG. 3 is a perspective view of a burner body which can be a component of a burner system with which the present invention can be utilized.

FIG. 3 illustrates a burner body useful in the practice of this invention. Burner body 21 includes plenum housing 22 formed by plenum back 24 and plenum sides 25 which are sealed together to enclose plenum space 23. If the plenum cross-section is rectangular, then plenum sides 25 may comprise planar surfaces forming a top, two sides, and a bottom. Preferably, the plenum cross-section is round and more preferably circular, in which case plenum sides 25 are in one continuous surface. In any case, plenum sides 25 terminate in front edge or edges 26 which form a uniplanar opening, that is, they define a plenum opening through which gas can flow as described herein. Flange 28 is preferably provided to provide a better seal with rear surface 3 of burner block 1. Inlet 27 communicates with plenum space 23, and can be connected to a source or sources of the gas to be supplied into plenum space 23 as described herein.

Burner body 21 also includes hollow body 31 which is situated completely within the plenum space 23.

Hollow body 31 completely encloses a space, which can be fed gas by way of feed inlet 32. Outlet ports 33 permit gas to flow out of the interior of hollow body 31. From 1 to 16, and preferably 1 to 4, outlet ports 33 are provided. Each outlet port 33 terminates at an end 34 which can extend up to, but not through or out of, the plane formed by front edges 26 of plenum housing 22. In that way, when the burner body is assembled to burner block 1, such that the front edges 26 contact the rear surface 3 of burner block 1 and seal the junction between those two pieces of apparatus, the outlet ports 33 do not extend out so far that such contact is impeded.

At least part, and preferably all, of the front surface 35 of hollow body 31 is spaced from the plane formed by front edges 26, so that plenum space 23 is considered to include not only space between the outer surfaces of hollow body 31 and the inner surfaces of plenum housing 22, but also space between front surface 35 and the plane formed by front edges 26. That spacing permits gas to flow from plenum space 23 to the openings 12 of passageways 11 that are not aligned by outlet ports 33.

Burner body 21 also includes first tube 41, which ends at first tube end 42. First tube 41 passes completely through plenum space 23 and protrudes beyond the plane formed by front edges 26. First tube 41 either passes through hollow body 31 as well, or is located next to hollow body 31 within plenum space 23.

Second tube 43 is located inside first tube 41, and third tube 45 is located within second tube 43. Second tube 43 and third tube 45 terminate at second tube end 44 and third tube end 46, respectively, both of which are located further from the plane formed by front edges 26 than the first tube end 42. That is, second tube 43 and third tube 45 both extend away from plenum housing 22 further than first tube 41 extends. Second tube end 44 and third tube end 46 are preferably coplanar.

The openings at the respective tube ends 42, 44 and/or 46 can be completely unobstructed, or any of them can contain segments that break the openings up into sub-openings which divide the emerging streams into sub-streams. For instance, a plate with a number of holes can be placed across the opening at the end 46 of third tube 45 to divide the fuel into a spray of a number of sub-streams.

Vanes can optionally be placed within space 47 and/or space 48 (within which gaseous oxidant streams can flow) to impart swirl that helps maintain flammability of the flame at the end of the burner.

The innermost tube, namely third tube 45, preferably receives the fuel which is to be combusted as described herein. Suitable fuels can be gaseous, liquid, solid, or any combination thereof, such as natural gas, LPG, propane, butane, fuel oil, diesel oil, coke oven gas, blast furnace gas, BOF gas, electric arc furnace gas, producer gas, any type of solid fuel, including slurries with some heating value. For operation with liquid fuel, an atomizing fluid (such as air, oxygen, nitrogen, fuel gas, argon, and steam) could be used. A nozzle to promote atomization of liquid fuel (with any kind of atomizing media, such as air, steam or other types of gas, or pressure atomizer) may be helpful. For operation with solid fuel, pulverizing it and then conveying it suspended in a carrier gas (such as air, nitrogen, argon, steam, fuel gas) would be helpful.

Figure 4:
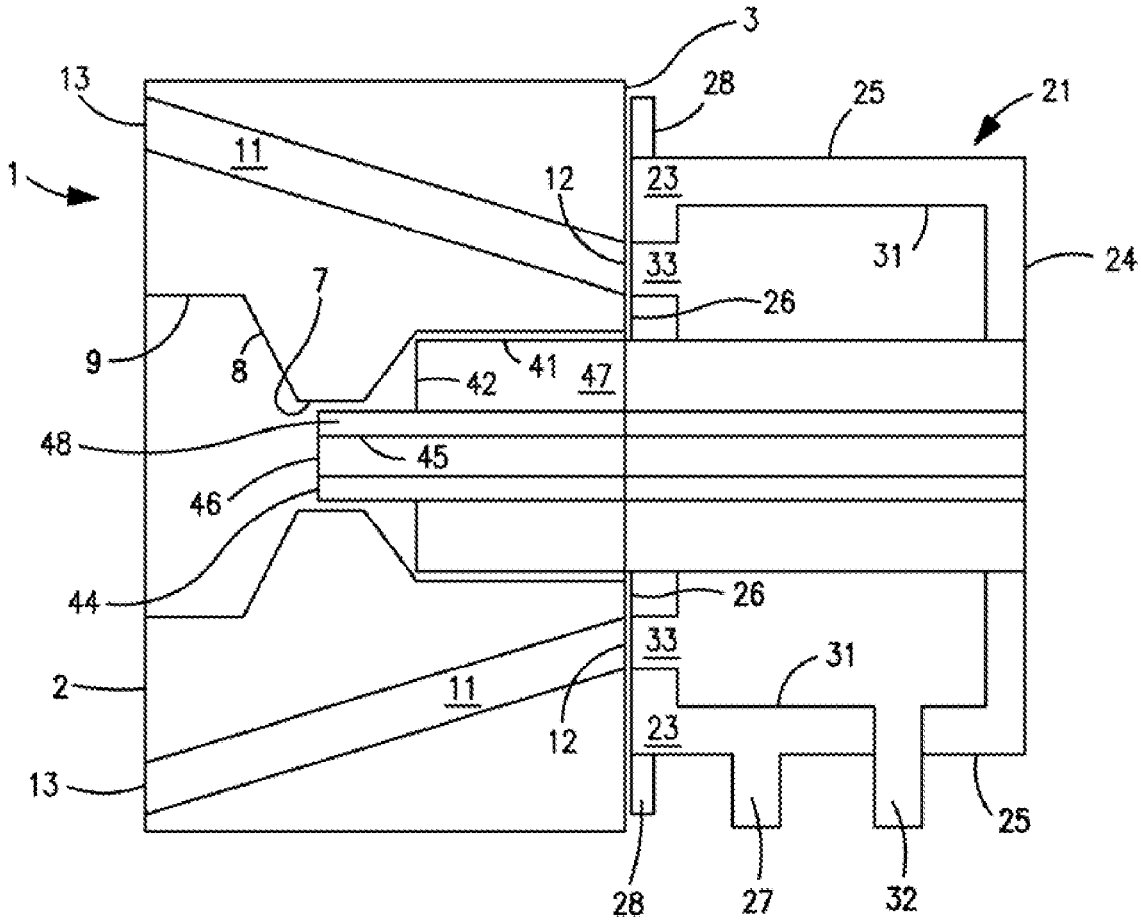
FIG. 4 is a cross-sectional view of a burner body and burner block assembled together to form a burner system with which the present invention can be used.

Referring to FIG. 4, the cooperation between burner block 1 and burner body 21 can be seen. With the front edges 26 of plenum housing 22 fully in contact with the rear surface 3 of burner block 1, gas cannot pass around those front edges 26. With burner body 21 so positioned against burner block 1, first tube 41 extends into barrel segment 5 which, as described above, is of a depth at least sufficient to receive the entire length of first tube 41. Second tube 43 and third tube 45 extend beyond the end 42 of first tube 41, into throat segment 7 but not past the downstream end of throat segment 7. In addition, the inlet openings 12 of secondary passageways 11 are close enough to first passageway 4 that they communicate directly with plenum space 23, so that gas can flow directly from plenum space 23 into and through secondary passageways 11 and out the respective discharge openings 13. FIG. 4 illustrates two outlet ports 33 aligned for flow of gas out of their respective ends into two passageways 11. However, as stated, gas also flows from plenum space 23 into other passageways 11, not shown in this particular cross-section, that are not aligned with outlet ports 33.

The upstream end of third (fuel) tube 45 is connected to a source of fuel through apparatus well known in this field which can feed fuel in any amount and rate desired, and can vary the amount and rate of feeding, and can turn on and shut off the flow of fuel when desired. Fuel is preferably fed at a rate of 10 to 1500, more preferably 15 to 1000, m/sec, and at a temperature of up to 1800° C.

The upstream end of space 47 between tubes 41 and 43, the upstream end of space 48 between tubes 43 and 45, as well as inlet 27 to plenum space 23, and inlet 32 to hollow body 31, are each connected by appropriate feed lines, valves, and controls to sources of gaseous oxidant (or mixtures of oxygen and one or more non-oxygen gases), thereby to permit control of the oxygen content of each of those gaseous streams, as well as the flow rates of each of those gaseous streams. In addition to controls that permit the flow of gas to any of these points to be turned on and shut off, controls that enable the practice of the present invention must also be present that enable the oxygen content and the flow rate of each such gaseous stream to be adjusted to any desired value as described herein, even while combustion is ongoing at the burner.

The upstream end of space 47 that feeds "primary oxidant" should be connected to gas sources and controls that enable the gaseous stream fed to space 47 to have (a) an oxygen content as low as the lowest that it may be desirable to feed into space 47, preferably at least 5 vol. % and more preferably at least 10 vol. %, (b) an oxygen content as high as the highest concentration that it may be desirable to feed into space 47, preferably at least 90 vol. % and more preferably at least 99.9 vol. %, and (c) an oxygen concentration anywhere between those lowest and highest values. This can be achieved by providing a source of high purity oxygen (at a purity that equals the highest concentration that is to be available for feeding into space 47), and providing a source of gas having the indicated lowest desired oxygen concentration, as well as optionally a source of gas (such as air) having an oxygen concentration between those lowest and highest values.

Controls should also be provided for controlling the amount of gas fed from each such gas source, so that any desired intermediate oxygen concentration that is between those lowest and highest values can be composed. A stream having any such intermediate oxygen concentration can be provided by combining streams from the respective sources upstream from space 47 and then feeding the combined stream into space 47, or by feeding streams from each source into the upstream end of space 47 in the appropriate relative amounts so that they mix in space 47 and form a mixture having the desired intermediate oxygen concentration. The oxidant should be supplied at a rate so that the stream emerges from end 42 of tube 41 at a velocity of 10 to 1500, preferably 15 to 500, m/sec. The temperature of the stream as it emerges is up to 1800° C.

Inlet 27 that feeds "secondary oxidant" via plenum 21 should be connected to gas sources and controls that enable the gaseous stream fed to inlet 27 to have (a) an oxygen content as low as the lowest that it may be desirable to feed into inlet 27, preferably at least 5 vol. % and more preferably at least 10 vol. %, (b) an oxygen content as high as the highest concentration that it may be desirable to feed into inlet 27, preferably at least 90 vol. % and more preferably at least 99.9 vol. %, and (c) an oxygen concentration anywhere between those lowest and highest values. This can be achieved by providing a source of high purity oxygen (at a purity that equals the highest concentration that is to be available for feeding into inlet 27), and providing a source of gas having the indicated lowest desired oxygen concentration, as well as optionally a source of gas (such as air) having an oxygen concentration between those lowest and highest values.

Controls should also be provided for controlling the amount of gas fed from each such gas source, so that any desired intermediate oxygen concentration that is between those lowest and highest values can be composed. A stream having any such intermediate oxygen concentration can be provided by combining streams from the respective sources upstream from inlet 27 and then feeding the combined stream into inlet 27, or by feeding streams from each source into the upstream end of inlet 27 in the appropriate relative amounts so that they mix in inlet 27 and form a mixture having the desired intermediate oxygen concentration. The oxidant should be supplied at a rate so that the stream emerges from discharge openings 13 at a velocity of 5 to 1500, preferably 6 to 1200, m/sec. The temperature of the stream as it emerges is up to 1800° C.

The upstream end of space 48 that feeds "primary oxygen" should be connected to gas sources and controls that enable the gaseous stream fed to space 48 to have (a) an oxygen content as low as the lowest that it may be desirable to feed into space 48, which may be zero (that is, the source provides a gas or a mixture of gases none of which is oxygen) and preferably at least 50 vol. %, (b) an oxygen content as high as the highest concentration that it may be desirable to feed into space 48, preferably at least 90 vol. % and more preferably at least 99.9 vol. %, and (c) an oxygen concentration anywhere between those lowest and highest values. This can be achieved by providing a source of high purity oxygen (at a purity that equals the highest concentration that is to be available for feeding into space 48), and providing a source of gas having the indicated lowest desired oxygen concentration, as well as optionally a source of gas (such as air) having an oxygen concentration between those lowest and highest values.

Controls should also be provided for controlling the amount of gas fed from each such gas source, so that any desired intermediate oxygen concentration that is between those lowest and highest values can be composed. A stream having any such intermediate oxygen concentration can be provided by combining streams from the respective sources upstream from space 48 and then feeding the combined stream into space 48, or by feeding streams from each source into the upstream end of space 48 in the appropriate relative amounts so that they mix in space 48 and form a mixture having the desired intermediate oxygen concentration. The oxidant should be supplied at a rate so that the stream emerges from end 44 of tube 43 at a velocity of 10 to 1500, preferably 15 to 500, m/sec. The temperature of the stream as it emerges is up to 1800° C.

Inlet 32 that feeds "secondary oxygen" via hollow body 31 and outlet port(s) 33 should be connected to gas sources and controls that enable the gaseous stream fed to inlet 32 to have (a) an oxygen content as low as the lowest that it may be desirable to feed into inlet 32, which may be zero (that is, the source provides a gas or a mixture of gases none of which is oxygen) and preferably at least 50 vol. %, (b) an oxygen content as high as the highest concentration that it may be desirable to feed into inlet 32, preferably at least 90 vol. % and more preferably at least 99.9 vol. %, and (c) an oxygen concentration anywhere between those lowest and highest values. This can be achieved by providing a source of high purity oxygen (at a purity that equals the highest concentration that is to be available for feeding into inlet 32), and providing a source of gas having the indicated lowest desired oxygen concentration, as well as optionally a source of gas (such as air) having an oxygen concentration between those lowest and highest values.

Controls should also be provided for controlling the amount of gas fed from each such gas source, so that any desired intermediate oxygen concentration that is between those lowest and highest values can be composed. A stream having any such intermediate oxygen concentration can be provided by combining streams from the respective sources upstream from inlet 32 and then feeding the combined stream into inlet 32, or by feeding streams from each source into the upstream end of inlet 32 in the appropriate relative amounts so that they mix in inlet 32 and form a mixture having the desired intermediate oxygen concentration. The oxidant should be supplied at a rate so that the stream emerges from discharge openings 13 at a velocity of 5 to 1500, preferably 6 to 1200, m/sec. The temperature of the stream as it emerges is up to 1800° C.

Of course, the same source of a given gas (such as a cylinder or air separation unit that provides high purity oxygen) can be used in providing a gas stream to more than one of the aforementioned inputs.

Using the Burner System

Now the use of the burner system will be described.

In the first phase of the method of the present invention, the heating needs are determined. The amount of heat to be transferred to the substrate is determined, on the basis of such factors as a desired increase in the temperature of the substrate, the mass of the substrate, the heat capacity, the heat of fusion if melting is to occur, and the like. The period of time within which the heat transfer is to be achieved is determined, giving the desired first rate of heat transfer to the substrate.

The temperature of the flame produced at the burner, to impart the heat transfer that is required for this first phase of the operation, can be achieved by setting the total oxygen concentration in the oxidant streams that are fed and combusted for a given degree of recirculation of the flue gas. At any given flue gas recirculation ratio, the flame temperature increases with increasing total oxygen concentration. At any given total oxygen concentration, the flame temperature increases with decreasing flue gas recirculation ratio. This permits determination of an effective total oxygen concentration in the oxidant streams fed through the burner, to achieve the required temperature.

Fuel is then combusted in a burner system such as that described herein, with oxygen that is fed as gaseous oxidant streams through and out of spaces 48 and/or 50, and that is fed out of discharge openings 13 of secondary passageways 11, having entered those secondary passageways from outlet ports 33 and/or from plenum space 23. The total amount of oxygen fed should be 0.6 to 2.0 times the amount of oxygen needed for complete combustion of the fuel. The fuel combusts in a flame whose base is at the end 46 of third (fuel) tube 45. The amount of oxygen fed to the burner system must be sufficient to enable combustion of the fuel to be maintained, at must be sufficient to provide that the fuel is sufficiently combusted so that the carbon monoxide content of the gaseous combustion products (i.e. the flue gas) produced by the combustion is less than 100 ppm. Also, as described more fully below, the feeds of gaseous oxidant are adjusted so that the amount of NOx formed by the combustion is minimized.

Then, in the second phase of the method of the present invention, when the heat transfer rate to the substrate is to change, the new (second) heat transfer rate is determined, again by considerations of factors such as a desired change (increase or decrease) in the temperature of the substrate, the mass of the substrate, the heat capacity, the heat of fusion if melting or solidification is to occur, and the like. The period of time within which the heat transfer is to be achieved is determined, giving the desired second rate of heat transfer to the substrate.

The temperature of the flame produced at the burner, to impart the desired second rate of heat transfer that is required for this second phase of the operation, can be achieved by setting the total oxygen concentration in the oxidant streams that are fed and combusted for a given degree of recirculation of the flue gas. At any given flue gas recirculation ratio, the flame temperature increases with increasing total oxygen concentration. At any given total oxygen concentration, the flame temperature increases with decreasing flue gas recirculation ratio. This permits determination of an effective total oxygen concentration in the oxidant streams fed through the burner, to achieve the required temperature.

Fuel is then combusted in a burner system such as that described herein, with oxygen that is fed as gaseous oxidant streams through and out of spaces 48 and/or 50, and out discharge openings 13 of secondary passageways 11, having entered those secondary passageways from outlet ports 33 and/or from plenum space 23. The total amount of oxygen fed should be 0.6 to 2.0 times the amount of oxygen needed for complete combustion of the fuel. The amount of oxygen fed to the burner system must be sufficient to enable combustion of the fuel to be maintained, at must be sufficient to provide that the fuel is sufficiently combusted so that the carbon monoxide content of the gaseous combustion products (i.e. the flue gas) produced by the combustion is less than 100 ppm. Also, as described more fully below, the feeds of gaseous oxidant are adjusted so that the amount of NOx formed by the combustion is minimized.

The preferred modes of carrying out combustion, and especially of modifying the combustion conditions (especially the total oxygen concentration) with various total oxygen concentrations, are as follows.

For combustion with a total oxygen concentration lower than 21% by volume, a portion of the total oxygen for combustion is introduced as primary oxidant through space 48, and the remaining oxygen required to complete the combustion process is introduced into plenum space 23 from which it passes through the secondary passages 11 and out of the discharge openings 13. This arrangement stages the combustion in a way that lowers the flame peak temperature, and consequently the NOx emission rate is lowered.

For combustion with total oxygen concentrations greater than or equal to 21 vol. % and less than 28 vol. %, one of the following procedures is preferred:

One preferred procedure is feeding oxidant through both of spaces 48 and 50, and raising the oxygen concentration of the oxidant steam fed into space 50 by adding oxygen (preferably as a stream of at least 90 vol. % purity oxygen) to that oxidant before feeding the resulting mixture into space 50. If desired, the amount of oxidant fed through space 48 is reduced or eliminated. The remaining oxygen required to complete the combustion process is supplied in the oxidant that is fed into plenum inlet 27 and into inlet 32 for hollow body 31, from where it enters secondary passageways 11 and flows out of discharge openings 13. Due to the elimination or significant reduction of the nitrogen content that results from the addition of the high purity oxygen, combined with the staging effect provided by the oxygen that is fed from the secondary passageways 11, the NOx emission rate is reduced.

A second preferred procedure with total oxygen concentrations greater than or equal to 21 vol. % and less than 28 vol. %, is feeding oxidant into and through space 48, without feeding any oxidant through space 50, and feeding the remaining oxygen required to complete the combustion process through the secondary passageways 11 from plenum space 23 and from hollow body 31. Due to the lower oxygen concentration in the fuel stream and in the stream emerging from space 48 compared to the first embodiment above, the temperature of the base of the flame tends to be lower. Due to this fact, the NOx emission rate is expected to be lower.

For combustion with total oxygen concentrations greater than or equal to 28 vol. %, one of the following operating procedures is preferred:

(a) One preferred procedure is feeding oxygen through space 50, without feeding any oxidant through space 48, and feeding the remaining oxygen required to complete the combustion into plenum space 23 and into hollow body 31 so that it passes through the secondary passageways 11 and combusts. The amount of oxygen in the oxidant introduced through the plenum is gradually reduced while the amount of oxygen in the oxidant introduced through the hollow body 31 and outlet ports 33 is gradually increased. The total oxygen introduced through the secondary passageways is determined based on the combustion process requirements. Due to the absence of nitrogen, or at least the significant reduction in the amount of nitrogen introduced with the oxygen, combined with the staging effect promoted by the oxidant streams fed out of the secondary passageways, the NOx emission rate is reduced.

(b) A second preferred procedure is feeding oxygen into and through space 48, and feeding the remaining oxygen required to complete the combustion into plenum space 23 and hollow body 31 so that it passes through and out of the secondary passageways 11. The amount of oxygen introduced through plenum 23 is gradually reduced while the amount of oxygen introduced through hollow body 31 increases. The total amount of oxygen introduced through the secondary passageways is determined based on the combustion process requirements. Due to the elimination or significant reduction of nitrogen in the oxidant feed streams, combined with the staging effect promoted by feeding oxygen from the secondary passageways, the NOx emission rate is reduced.

(c) A third procedure is feeding oxidant or high purity (at least 90 vol. % oxygen) through only inlets 50 and 32, without feeding any oxidant through inlets 48 and 27. Due to the elimination of the other oxidant streams, combined with the staging effect provided by the streams emerging from secondary passageways that are fed from outlet ports 33, the NOx emission rate is reduced to the lowest level.

NOx Control

In each phase of the method of the present invention, the flows of gaseous oxidant to the respective outlets of the burner system are adjusted so that NOx production is minimized. The burner design of the invention disclosed herein enables establishing low minimized NOx emission levels at any of the various combustion conditions. To minimize NOx production during combustion, one or more of the following methods can be employed:

staging of the oxygen contents between the oxidant streams that are fed from spaces 48 and 50, and the oxidant streams that are fed from the secondary passageways;

feeding oxygen of at least 90 vol. % to spaces 48 and/or 50 (thereby minimizing the nitrogen content in those streams) only when operating the burner with total oxygen concentration above 20.9 vol. %;

the secondary passageways 11 all forming diverging angles relative to the axis of the first passageway 4.

The staging, and the degree of staging, can be accomplished by varying any one or more of the following parameters:

The ratio between the flow rates and the oxygen contents of the stream emerging from space 48 and the streams fed by the plenum, The ratio of the oxygen flow rates in the stream emerging from space 50 and the streams fed from hollow body 31 and its outlet ports 33;

The magnitude of the diverging angle of the secondary passageways 11;

The distance between the center of the secondary oxidant discharge openings 13 and the center of the fuel tube 45;

The number of discharge openings 13;

The velocity and the momentum of the streams exiting the secondary passageways 11.

Lower NOx emission rates are expected for higher degree of staging. The staging limit is determined by the flame stability at the lowest NOx and CO emission rates of each set of combustion conditions. The present invention is capable of operating at firing densities within the range from 60 to 500 $kW/m^3$.

Advantages

The combustion method and apparatus disclosed herein allow fuel to combust with oxidant streams presenting a total oxygen concentration from the minimum required to promote flame stability up to 100%.

Another significant advantage is that the oxygen concentrations, and the feed rates, of any or all of the oxidant streams can be changed while combustion continues, that is, without discontinuing and recommencing the combustion.

In addition, the present invention produces satisfactorily low CO emissions.

Other advantages of the present invention include the following:

The invention promotes the combustion process at any oxygen concentration in oxidant within the range from 20.9 vol. % (or lower if flame stability can be achieved) up to 100 vol. %, and have the oxygen concentration changed during the ongoing combustion.

The invention promotes minimized NOx emission rate at each level of oxygen concentration in the oxidant that is fed, with acceptable levels of CO generation.

The invention minimizes NOx emission rates achieved at firing densities compatible with actual industrial furnaces, i.e., at firing densities within the range from 60 to 500 $kW/m^3$, with acceptable levels of CO generation.

The invention avoids the need to provide two separate heating stations, one with oxygen-fired combustion and one with air-fired combustion, to accommodate situations presenting different heat transfer rates.

Other advantages of the present invention appear in operational applications. For instance, yield improvement can be obtained in applications where oxidation is a concern, such as aluminum melting and steel reheating.

Specific fuel consumption is low, and is optimized, throughout the sequence of steps such as heating and holding operations.

Better and more uniform heat transfer and temperature distribution are attained.

Exemplary

In a metal melting process, a given target temperature (which can be related to the charge temperature or to the product temperature or to the furnace refractory temperature or to the flue gas temperature or a combination of them) can be achieved for different oxygen concentrations in the oxidant streams fed to the burner system and combusted thereat. In order to achieve the best performance (in this case, rapid melting rate), the application of pure oxygen is suitable for the melting phase. However, once the melting phase is completed, the use of pure oxygen in combusting the fuel is not economically justifiable. In accordance with this invention, the total oxygen concentration in the oxidant streams fed to the burner system and combusted thereat is reduced to a level sufficient to keep the metal molten and hot.

Another example is that if the refractory lining of a ladle has to be held at a given temperature for a long period of time, the burner system can be operated with the lowest total oxygen concentration that will sustain combustion at that given temperature. When there is a need to increase the temperature of the ladle lining, the total oxygen concentration is increased (on the fly) to the most economic (minimized cost) level that raises the temperature at the desired rate. Improved ladle refractory heating and preheating, and extended refractory lifetime, are attained due to the ability to promote drying and curing with a relatively low peak flame temperature (attained by carrying out combustion with feeding of relatively low total oxygen concentration) in new refractory lining, and short heating cycle (higher heat transfer rates, obtained by combusting with relatively higher total oxygen concentration) in ladles in use to receive and hold molten metal.

Another example of the use of the method of the present invention is in continuous or non-continuous steel reheat furnaces that are used to heat slabs of steel. For throughput increases, i.e., boosting, the present invention can be used by combusting fuel with oxidant streams having a high total oxygen concentration when the maximum throughput is required. If the throughput requirement lowers, then the total oxygen concentration is lowered by an amount based on the new lower needs. That allows the burner system to be run at a steady rate (not going through high fire and low fire modes) which would maintain steady furnace temperature.

A simple quantitative example can be given in a ladle preheating application. Preferred practice is to preheat a ladle, quickly, before molten metal is fed ("tapped") into the ladle. The preheating increases the lifetime of the refractory (to avoid/minimize thermal shocks) and to minimize temperature drop of the molten metal tapped into the ladle. For fast heating, combustion with a high total oxygen concentration is the most suitable application. If the ladle preheating station uses an oxy-air-burner that can only switch between oxy-fuel combustion (100% oxygen in the oxidant) and air-fuel combustion (combustion with air as the only oxidant), the usual operation is to run the burner in oxy-fuel mode in the heating cycle to heat the ladle refractory lining quickly and make the ladle available to the melt shop in a short period of time. When there is a delay in the melt shop the ladle is put "on hold" and the burner would be operated with air (20.9% oxygen concentration in oxidant). If suddenly there is a requirement to heat up the ladle refractory lining in such a way that the net energy required is of 1 MM Btu (293 kW) in 10 min, the burner could be switched to oxy-fuel mode and be operated intermittently, i.e., turned off when the set point is achieved and turned on when the temperature of the ladle refractory lining drops. This operation could cause thermal stress to the ladle refractory lining lowering its useful life. Besides that, this type of operation could also cause problems (such as fatigue) to the valves on the control system (because of the frequent repeated intermittent on/off operation).

With the method of the present invention, the burner system could be operated at the following condition. Assuming that the burner is rated to fire 10 MM Btu/h (2930 kW), . . . if the net energy requirement is of 1 MM Btu in 10 min and the burner is rated to deliver 1.7 MM Btu (500 kW) in 10 min (10 MM Btu/h×10 min/60 min), this represents a thermal efficiency (or net heat available) of 60% throughout the 10 min of operation. Knowing the flue gas temperature would be 1200° C., the oxygen concentration in the total oxidant fed that corresponds to the net heat available of 60% is determined to be 40% by volume. Thus, the burner described herein could be steadily operated by combusting fuel with an oxidant stream containing 40% by volume of oxygen, which would promote a smooth increase in temperature of the ladle refractory lining thereby avoiding unnecessary and undesired thermal stress.

If due to the production schedule requirement the heating rate needs to be changed again, the same procedure would be put in practice, i.e., the total oxygen concentration in the oxidant streams fed to the burner system is varied on the fly, avoiding sudden changes in heat transfer. The fact that the total oxygen concentration can be varied while combustion is ongoing, without interrupting the combustion, and providing any desired level of total oxygen concentration, brings an economic advantage since the combustion system can always be operated at the minimum cost condition while promoting the lowest NOx emission at that particular total oxygen concentration.

What is claimed is:

1. A method for heating a substrate, comprising:

(A) providing a burner system comprising a burner body and a burner block, wherein (i) the burner body comprises a plenum body which has back and side surfaces that enclose a plenum space which is open at its front in a uniplanar plenum opening that is defined by the front edges of said side surface, a feed inlet in a back or side surface of said plenum body, through which gas can be fed into said plenum space, a first hollow body that is situated completely within said plenum space and that is closed against passage of gas between said plenum space and the interior of said hollow body, wherein the hollow body does not extend through said plenum opening, a feed inlet through a surface of said hollow body, through which gas can be fed into the interior of said hollow body, 2 to 16 outlet ports through a surface of said hollow body, through which gas can pass out of said hollow body, each oriented to point outwardly of said plenum space toward the plenum opening, wherein the outer ends of said outlet ports do not extend beyond the plane of said plenum opening, a first tube extending from outside the back surface of said plenum body through the plenum space to a first tube end that is located a first distance outside the plane of the plenum opening, wherein the first tube is closed against passage of gas into said first tube from the plenum space and from the interior of the hollow body, a second tube, located inside the first tube, extending from outside the back surface of said plenum body through the plenum space to a second tube end that is located a second distance outside the plane of the plenum opening, wherein said second distance is greater than first distance, wherein said second tube is closed against passage of gas into said second tube from the plenum space, from the interior of the hollow body, and from the first tube, and wherein the axes of the first and second tubes are coaxial or parallel, a third tube, located inside the second tube, extending from outside the back surface of said plenum body through the plenum space to a third tube end that is located said second distance outside the plane of the plenum opening, wherein said third tube is closed against passage of gas into said third tube from the plenum space, from the interior of the hollow body, and from the second tube, and wherein the axes of the first, second and third tubes are coaxial or parallel, a feed inlet for receiving gas into the space between the first and second tubes, a feed inlet for receiving gas into the space between the second and third tubes, and a feed inlet for receiving fuel into said third tube; and (ii) the burner block comprises a front surface and a rear surface, a first passageway extending through the block, composed of a barrel segment that extends into the block from said rear surface to the inner end of said barrel segment for a length at least equal to said first distance, the diameter of said barrel segment permitting said first tube to fit snugly into said barrel segment to minimize passage of gas in said barrel segment outside said first tube, a throat segment having upstream and downstream ends and whose diameter is constant along its axis and is less than the diameter of said barrel segment and is greater than the outer diameter of said second tube, wherein the distance from the rear surface of the block to said upstream end is greater than said first distance and less than said second distance, and wherein the distance from the rear surface of said block to said downstream end is greater than said second distance, a tapered segment that extends axially from the inner end of said barrel segment to said upstream end of said throat segment, a port segment that extends into the block from the front surface of the block to the inner end of the port segment, wherein the diameter of the port segment is constant and is greater than the diameter of said throat segment a quarl segment that extends from the downstream end of said throat segment to the inner end of said port segment, wherein said segments are coaxial, and the sum of the axial lengths of the port segment and the quarl segment is up to 50 times the diameter of the largest diameter of the quarl segment; the axial length of the throat segment is up to 50 times the diameter of the largest diameter of the quarl segment; the ratio of the largest diameter of the quarl segment to the diameter of the throat segment is 1 to 50; and the distance from the discharge openings of the secondary passageways to the axis of the first passageway is 1-10 times the diameter of the throat segment, a plurality of secondary passageways, greater in number than the number of said outlet ports, extending through said block from inlet openings in the rear surface of said block to discharge openings in the front surface of said block, wherein said inlet openings arc close enough to said first passageway that when the front edges of said plenum body are in contact with the rear surface of said block, said inlet openings are in gas contact with said plenum space, and wherein each secondary passageway has an axis at its discharge opening that converges toward the axis of the first passageway at an angle of up to 60°, diverges from the axis of the first passageway at an angle of up to 85°, or is parallel to the axis of the first passageway;

and wherein said burner body is positioned with respect to said burner block so that the front edges of said plenum body are in contact with the rear surface of said block to prevent passage of gas out of said plenum space except into said secondary passageways and the first and second tubes extend into said first passageway, and outlet ports are aligned with secondary passageways so that gas passing from an outlet port passes through a secondary passageway with which it is aligned, (B) determining a first rate of heat transfer to the substrate, (C) determining the rates at which fuel and oxidant are to be fed to said burner system to be combusted thereat, and the total oxygen concentration of said oxidant to be combusted, to generate heat of combustion to be transferred to said substrate from said burner system at said first rate, (D) feeding fuel, and oxidant having said total oxygen concentration, at said rates to said burner system and combusting said fuel and said oxidant at said system to generate heat of combustion which is transferred to said substrate at said first rate, while apportioning the amounts of oxygen fed through said first and second tubes of said burner system with respect to the amounts of oxygen fed through said secondary passageways and said outlet ports of said burner system to minimize formation of NOx by said combustion, (E) determining a second rate of heat transfer to the substrate which is different from said first rate, (F) determining a new total oxygen concentration of said oxidant to be combusted and determining new rates at which said oxidant, or said oxidant and said fuel, are to be fed to said burner system and combusted thereat to generate heat of combustion to be transferred to said substrate at said second rate, and (G) while continuing to feed fuel and oxidant to said burner system, changing the total oxygen concentration fed to said burner system to said new total oxygen concentration and changing the rate at which said oxidant or said oxidant and said fuel are fed to said burner system, and continuing to combust said fuel and oxidant at said burner system, without discontinuing said combustion, to generate heat of combustion which is transferred to said substrate at said second rate, while apportioning the amounts of oxygen fed through said first and second tubes with respect to the amounts of oxygen fed through said secondary passageways and said outlet ports to minimize formation of NOx by said combustion, wherein the amount of oxygen fed to said burner system is at all times sufficient to maintain combustion of said fuel at said burner system, and wherein the amount of oxygen fed to said burner system is at all times sufficient to maintain the carbon monoxide content of the gaseous products of said combustion at less than 100 ppm.

2. A method according to claim 1 wherein heat is transferred to said substrate at said first rate to melt all or a portion of said substrate, and heat is transferred to said substrate at said second rate to maintain said molten substrate in the molten state.

3. A method according to claim 1 wherein said substrate is a ladle, heat is transferred to said ladle at a first rate to heat the ladle, and heat is transferred to said ladle at said second rate to a higher temperature.

4. A method according to claim 1 wherein heat is transferred at said first rate in a steel reheating furnace to slabs of steel passing through said furnace at a first rate of throughput, and heat is transferred at said second rate to slabs of steel passing through said furnace a second rate of through put different from said first rate of throughput.

* * * * *